United States Patent [19]

Trinne et al.

[11] 3,946,770

[45] Mar. 30, 1976

[54] BOTTLE FILLING MEANS AND METHOD

[76] Inventors: John Thomas Trinne, Box 197, Greenock Road, Nuriootpa, Australia, 5355; Leslie John Wilksch, King St., Stockwell, Australia, 5350

[22] Filed: Nov. 19, 1974

[21] Appl. No.: 525,195

[30] Foreign Application Priority Data

Nov. 22, 1973 Australia ..... 5728/73

[52] U.S. Cl. ..... 141/5; 141/14; 141/39

[51] Int. Cl.[2] ..... B65B 3/04

[58] Field of Search ..... 141/5, 6, 14, 15, 16, 37–64, 141/230, 374

[56] References Cited

UNITED STATES PATENTS 921,032 5/1909 Webster et al. ..... 141/39

*Primary Examiner*—Houston S. Bell, Jr.

*Attorney, Agent, or Firm*—Jay L. Chaskin

[57] ABSTRACT

Bottle filling means suitable for filling a bottle with aerated or sparkling liquid, (for example sparkling wine) contained in a bowl at superatmospheric pressure, comprising a float valve in the bowl which establishes a liquid level therein, at least two valves carried by the bowl and operated by a cam track engaged by the valves upon rotation of the bowl, a first valve being a liquid flow valve, opening to initiate a syphon action of the liquid from the bowl into the bottle through a syphon tube depending from the valve, a second valve, a bottle venting valve, opening to vent displaced air and gas from the bottle as it is filled, the bottle venting valve being connected to a flow meter which regulates rate of release of gas to atmosphere, so that the bottle fills rapidly but with a minimum of turbulence, a minimum of loss of carbon dioxide gas, and a minimum of oxidation due to the air contained in the bottle.

13 Claims, 8 Drawing Figures

BOTTLE FILLING MEANS AND METHOD

This invention relates both to a bottle filling means and also to a method which is useful for the filling of a bottle with liquid contained in a bowl and containing gas under superatmospheric pressure, for example, sparkling wine. Such a machine is known in the trade as a "counter pressure filling machine".

BACKGROUND OF THE INVENTION

Two main difficulties are encountered with counter pressure filling machines commonly used in the trade. The pressure at which they operate is often in the order of 60 to 70 pounds per square inch, and this comparatively high pressure causes some of the wine or other aerated liquid to "boil over" as filling takes place. Furthermore filling is usually effected into the bottle from near its open mouth, and this results in considerable turbulence of the liquid as it passes into the bottle with the consequential loss of carbon dioxide gas from the liquid. In order to reduce turbulence and therefore to reduce loss of carbon dioxide gas, the liquid is frequently directed against the inner walls of the bottle, but this results in a slower filling rate. One of the main objects of this invention therefore, is to provide a means and method whereby a bottle is filled with much less turbulence than theretofore, and further to use a lower pressure than heretofore, so as to reduce the boiling over effect, thus reducing and in some cases completely avoiding loss of liquid.

A second main difficulty which is encountered is oxidation of certain liquids. Delicate sparkling wines are adversely effected if they are subjected to the action of oxygen but of course there is oxygen present in a bottle before it is filled with liquid. With previously used counter pressure machines, turbulence has resulted in exposing a large amount of surface area of the sparkling wine to the effects of oxygen, and a further object of this invention is to reduce the surface area of the wine which is exposed to oxygen and thus in turn reduce oxidation of the wine, when the invention is made use of in the filling of bottles with sparkling wine.

In our copending application, Ser. No. 478,539, filed June 12, 1974, we described a bottle filling means and method the object of which was to fill still wines or other liquids with a minimum of aeration by utilising a syphon method. By using a syphon method a relatively large tube may be employed to give a large cross-sectional area for the liquid flow, and the tube may extend almost to the bottom of the bottle being filled, the liquid flowing into the bottle with very little turbulence so that there is a minimum of aeration. However a counter pressure filling device and method is essentially much more complex since the bottle is filled under pressure.

BRIEF SUMMARY OF THE INVENTION

Briefly the invention may be summarised as comprising a frame supporting the bowl which contains aerated or sparkling liquid (for example sparkling wine) to a liquid level which is determined by a float valve in the bowl, a liquid flow valve carried by the bowl but above the liquid level, a syphon tube extending down from the liquid flow valve into the bowl below the liquid level, a bottle venting valve, a gas flow conduit having its inlet adjacent the outer surface of a syphon tube which depends from the liquid flow valve, the gas flow conduit extending to the bottle venting valve, and a flow meter coupled to the outlet of the bottle venting valve so as to regulate release of gas contained at pressure to atmosphere. The valves may conveniently be operated by cam means carried on a frame with respect to which the bowl rotates.

More specifically the invention may be defined as bottle filling means suitable for the filling of a bottle with liquid contained in a bowl and containing gas under superatmospheric pressure, comprising a frame supporting the bowl, a liquid inlet conduit, a float valve supported by the bowl in liquid flow communication with said conduit and having a liquid discharge outlet and a float contained within the bowl establishing a liquid level therein, a liquid flow valve carried by the bowl, a liquid delivery tube terminating at its inlet end in the bowl below the liquid level and at its outlet end in the inlet of said valve above the liquid level, and a syphon tube having an open lower end depending from the outlet of said valve, a bottle venting valve, a gas flow conduit having its inlet adjacent the outer surface of said depending tube and extending to the inlet of the bottle venting valve, a flow meter, and a gas venting tube extending from the outlet of said bottle venting valve to the inlet of the flow meter, said flow meter being operable to regulate rate of release of gas contained at pressure in the venting tube to atmosphere, and valve control means coupled to said valves and opening the liquid flow valve and the bottle venting valve.

Again, more specifically the method of the invention may be defined as comprising the steps of charging the bowl with liquid and with carbon dioxide gas at superatmospheric pressure, positioning the bottle over the syphon tube, opening the liquid flow valve and the bottle venting valve to effect transfer of liquids from the bowl to the bottle by a syphon action, and removing the bottle from the syphon tube after filling. The liquid flow valve and bottle venting valve may conveniently be in a single valve body, although in some instances it may be preferred by those skilled in the art to utilise separate valves for these and other purposes. Further, the valve control means can be constituted by cam tracks, rollers or the like carried by the frame and engageable against a valve plunger as the bowl rotates together with its valves.

BRIEF DESCRIPTION OF THE DRAWINGS

An embodiment of the invention is described hereunder with reference to and as illustrated in the accompanying drawings in which.

DETAILED DESCRIPTION OF THE DRAWINGS

Figure 1:
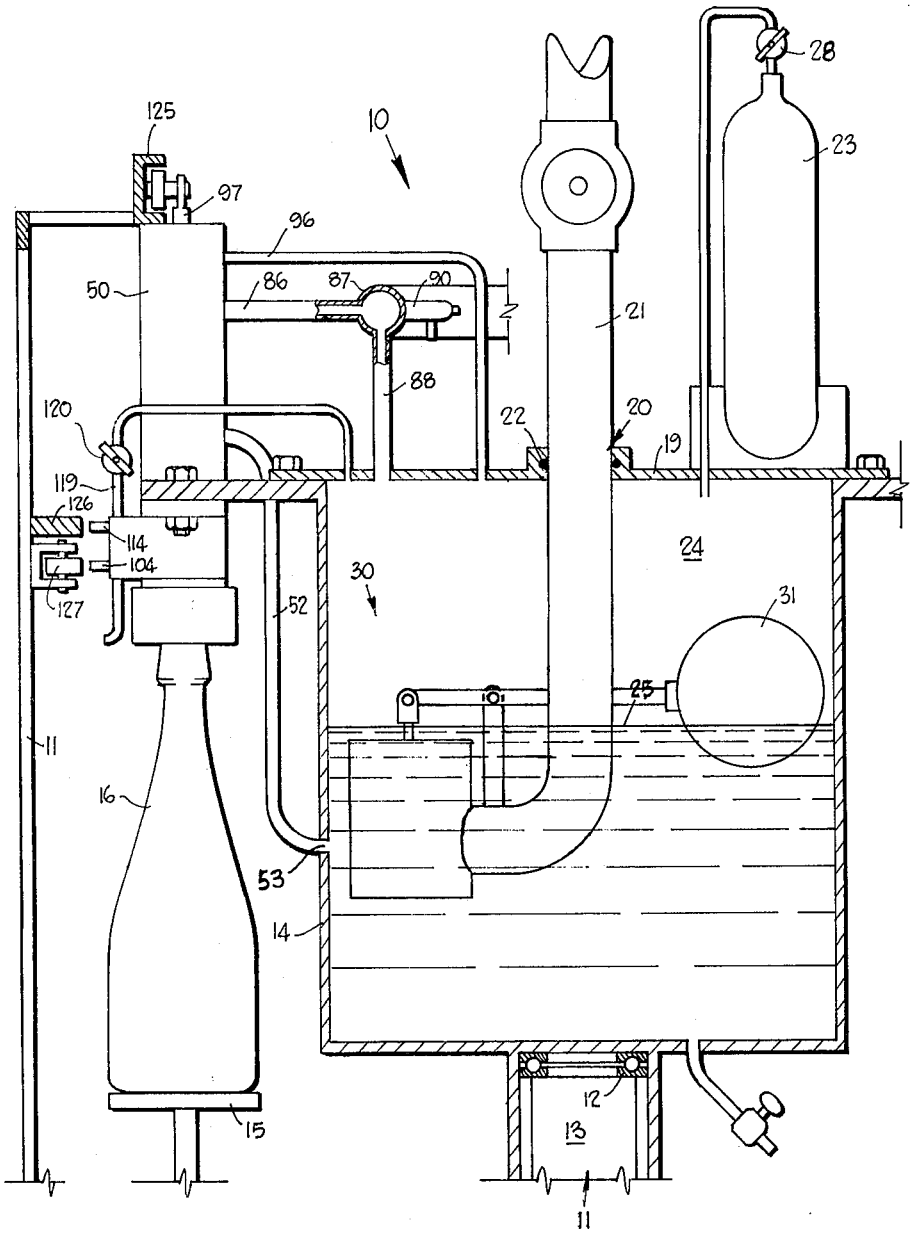
FIG. 1 is a partly sectioned view of a bottle filling machine showing a frame, a bowl rotatable with respect to the frame, a valve and a bottle being filled.

FIG. 1 illustrates only portion of a bottle filling machine designated 10 the machine having a frame 11 with bearings 12 on the end of a stem 13 of the frame 11 to rotationally support a bowl 14. The machine is provided with rotating elevating feet 15 which support respective bottles 16, the bottles being elevated as the machine rotates. The elevating feet 15 form part of known prior art, most botting machines of the index type being provided with such mechanisms, and therefore the devices for elevating feet 15 are not described in detail herein.

The rotating bowl 14 has a closure member 19 containing a central aperture 20, through which a liquid inlet tube 21 passes, there being provided a resilient non-metallic sealing ring 22 between the tube 21 and the walls defining the aperture 20 so that carbon dioxide gas from a gas container 23 may be maintained in the space 24 above the level 25 maintained by a pressure regulator 28, in this embodiment to about 40 pounds per square inch, that is about two-thirds of the pressure usually employed in counter pressure filling machines. This low pressure is of value in reducing tendency of boil over of the liquid from the bottle 16 as the bottle is removed from being filled.

Figure 2:
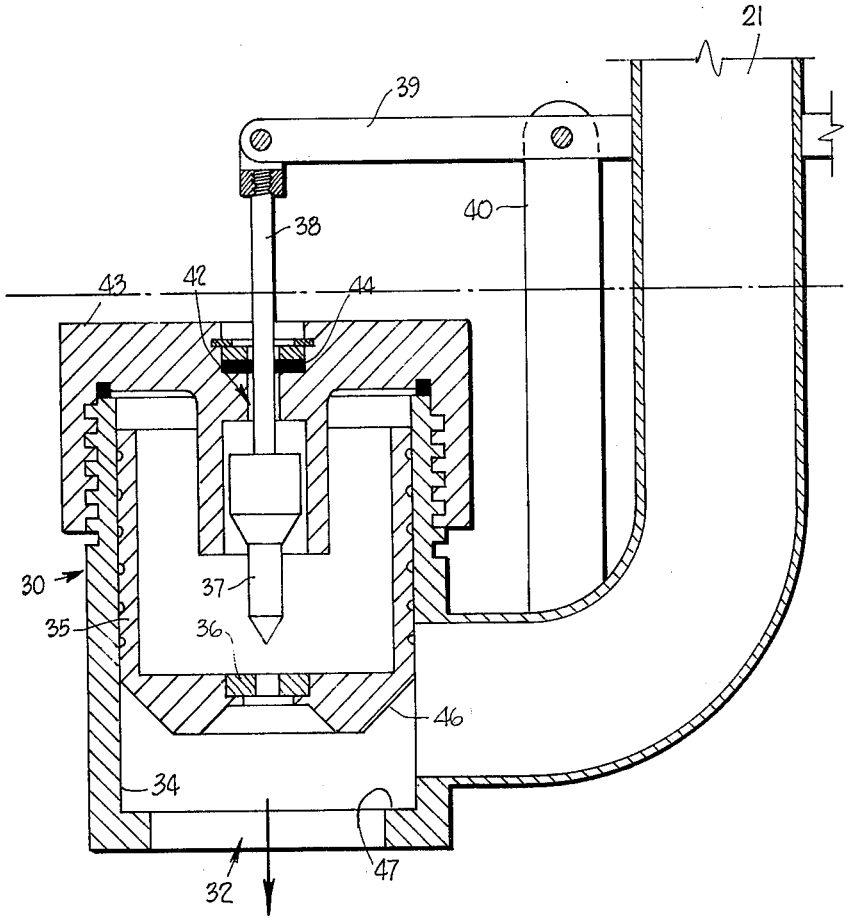
FIG. 2 is an enlarged section through the float valve which is illustrated generally in FIG. 1.

Referring now more specifically to FIG. 2, a float valve generally designated 30 carried on the lower end of the liquid inlet tube 21, the float valve 30 having a float 31 (which establishes the level 25), and a discharge opening 32 which are essentially contained within the bowl 14. It might be referred to at this point that in some embodiments the float valve 30 may itself be positioned externally of the bowl 14, so as to be more readily accessible for maintenance purposes. However in the embodiment illustrated the float valve 30 together with its float 31 is contained wholly within the bowl 14.

The float valve 30 is a servo valve and comprises a cylinder 34, a cup-like member 35 which is freely slidable in the cylinder 34, a master valve seat 36 in the base of the cup-like member 35, a master valve member 37 within the cup-like member 35, and co-operable with the seat 36, a plunger 38 and a float arm 30 pivoted to a bracket 40 constituting means coupling the master valve member 37 to the float 31. The plunger 38 passes through an aperture 42 in a screw threaded closure cap 43 which sealably engages the cylinder 34, and a resilient seal ring 44 which sealably and slidably engages the plunger 38.

The master valve member 37 co-operates with the master valve seat 36 to open or close the master valve. The lower end of the cup-like member 35 comprises a frusto conical slave valve surface 46 which co-operates with a slave valve seat 47 to open or close the float valve 30. The arrangement is such that some liquid can pass between the walls of the cup-like member 35 and the cylinder 34 so that the cup-like member tends to continuously fill with liquid. The whole valve is submerged and the cup is always full. However, upon raising of the master valve member, liquid in the cup can discharge so that the effective pressure acting downwardly on the cup-like member 35 is reduced and this allows it to rise due to the reaction of liquid flow through the valve as it changes direction and also due to the upthrust of the pressure applied to the bottom of the cup-like member 35. The pressure reduces as the member 35 rises, and there is thereby provided a simple efficient and sensitive servo float valve which is found in practice to maintain liquid level in the bowl 14 within very close limits notwithstanding wide variations in discharge rates as the bottles are filled from the bowl.

As said above, use may be made of separate valves arranged side by side, but in this embodiment a more effective arrangement is disclosed wherein a liquid flow valve, a bottle venting valve, a gassing spool valve, a pressure release valve and a tube venting valve are all contained within a single valve body 50.

Figure 3:
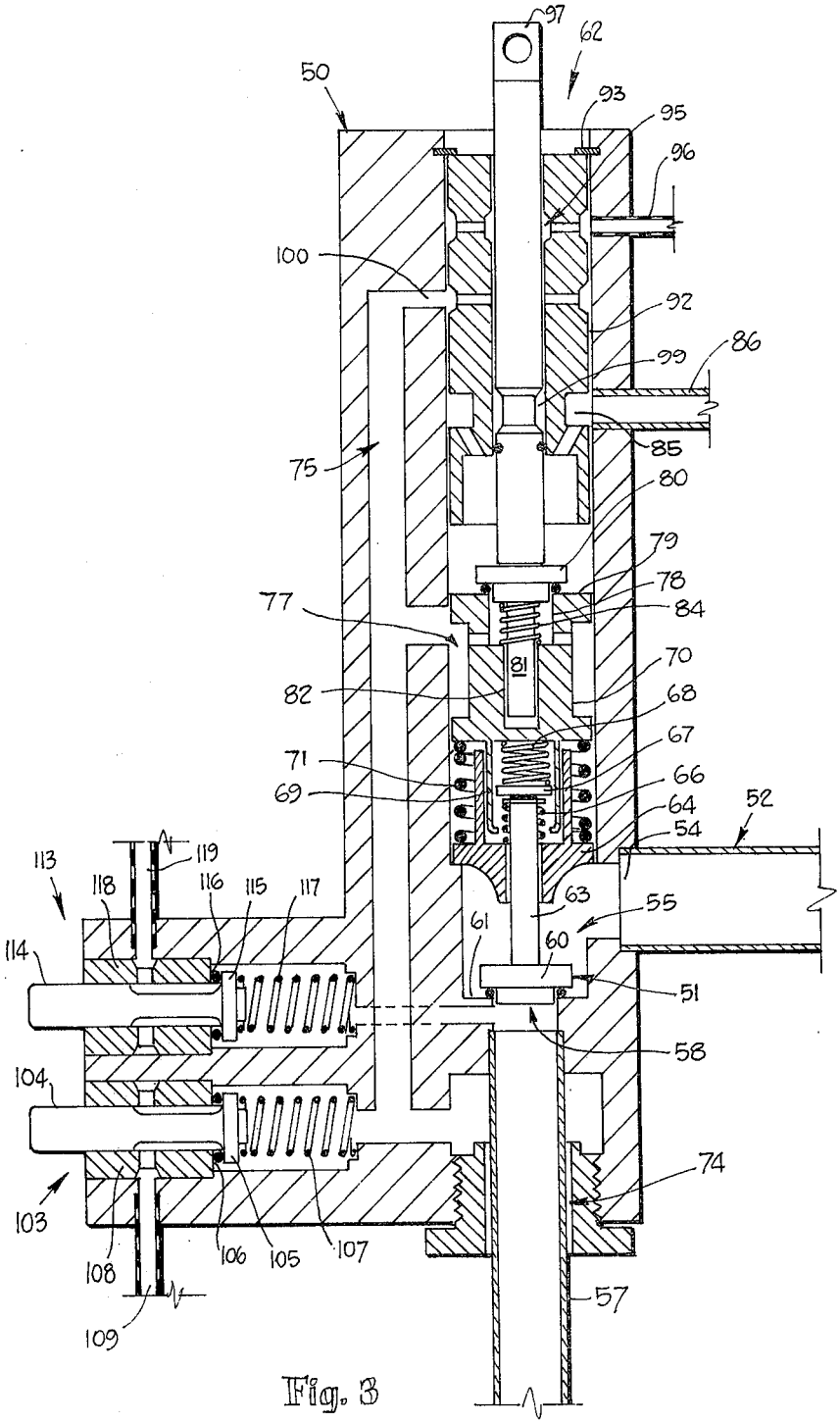
FIG. 3 is a section through a valve body containing the valves and showing the valves in their closed positions.

FIGS. 3 through to 8 illustrate in detail the valves contained in the valve body 50 and show the various stages in the filling of a bottle. In FIG. 3 the valves are shown as all being closed, the condition which exists before commencement of filling. The valve body 50 contains within it a liquid flow valve 51, there being a liquid delivery tube 52 which terminates at its inlet end 53 within the bowl 14, below the liquid level 25 and at its outlet end 54 in the inlet 55 of the liquid flow valve 51. The valve body 50 has depending from it a syphon tube 57 having an open lower end (not shown), and this depends from the outlet 58 of the liquid flow valve 51. The liquid flow valve 51 is a poppet valve having a head 60 which co-operates with an annular valve seat 61 formed by the shoulder at the lower end of a bore 62 which extends vertically through the valve body 50, and a stem 63 which is slidable within sleeves 64 retained in the bore 62. The stem 63 has surrounding it a light spring designated 66 which biases it towards an open direction, but in the position shown in FIG. 3 the spring 66 is compressed by an abutment disc 67 loaded downwardly by a spring 68 contained in a tube 69 which depends from a piston 70. The piston is normally urged upwardly by a heavier spring 71 but this is also compressed in FIG. 3 as described below.

The syphon tube 57 depends through the lower end of the valve body 50, passing through an opening 74 of larger diameter than the syphon tube 57 so that the opening 74 constitutes an inlet to a gas flow conduit designated 75 in the body 50. Although not shown in the drawings, the resilient means are provided for sealing the mouth of a bottle which is moved upwardly over the syphon tube 57 against the lower end of the body 50. Such sealing means are well known and in common use in the art. The opening 74 then provides means for venting air and other gas contained in the bottle into the gas flow conduit 75 as described below.

The gas flow conduit 75 extends to an opening 77 in the piston 70, the opening 77 itself extending in to a central bore 78 of the piston 70, the upper end of the piston 70 then having an annular surface 79 which forms a valve seat for co-operable engagement with the head 80 of a poppet valve 81, the stem of the poppet valve 81 depending into a central recess 82 in the piston 70. As in the case of the liquid flow valve 51, the stem is surrounded by a light spring designated 84. This spring 84 biases the poppet valve 81 towards an open position. The poppet valve 81 and surface 79 combine to form a bottle venting valve, and as explained above the gas flow conduit 75 opens into the inlet of the venting valve. The outlet of the venting valve is designated 85 and joins the inlet end of a gas venting tube 86 which extends into a manifold 87 (to which similar tubes 86 are connected around the bowl 14), the manifold 87 being coupled by a conduit 88 to the space 24 within the bowl 14. Also coupled to the manifold 87 is a flow meter designated 90 of known type which functions to regulate the rate of discharge of gas from the manifold 87. The discharge of gas is much faster than can flow through the conduit 88, so that there is normally an outward flow from the space 24 through the flow meter 90. Similarly there is an outward flow of gas from the gas flow conduit 75 through the flow meter 90. Flow meters of many types are available which are useful for this purpose, and in the embodiment described herein the flow meter selected was producted by Societe L'Air Liquide, Paris, France and sold under the designation "Mini Bloc."

Figure 5:
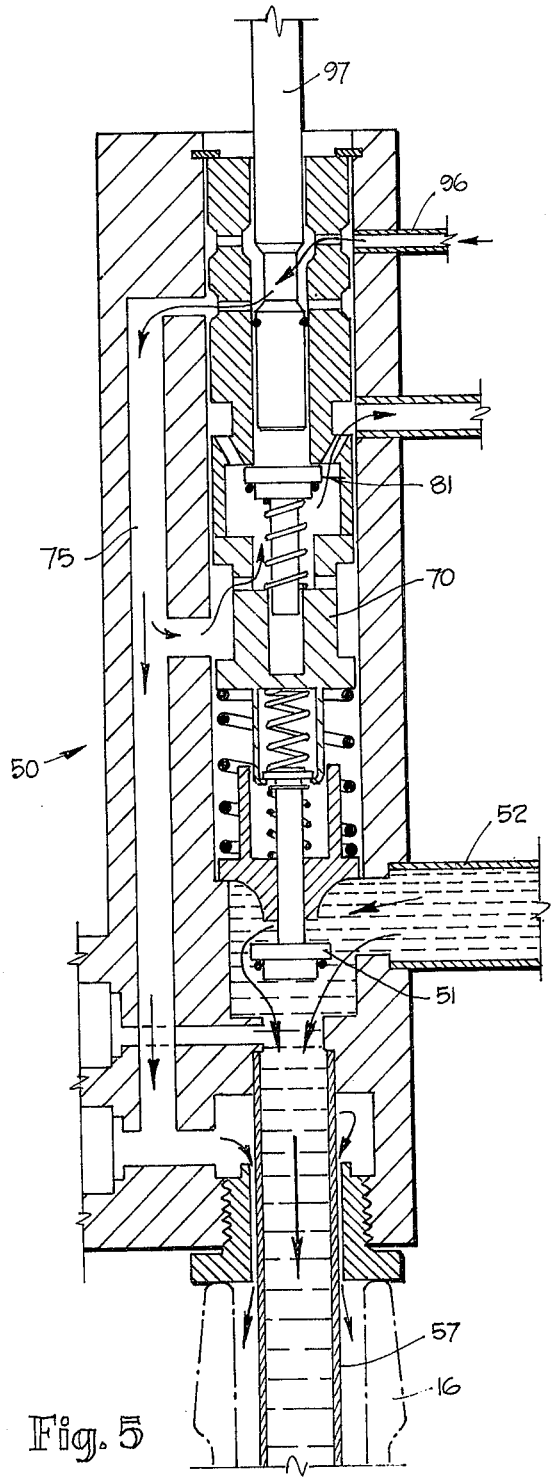
FIG. 5 is again a similar section to that of FIGS. 3 and 4 showing a further (gassing) spool valve in its open position, while the liquid flow and bottle venting valves are fully open.

The upper end of the bore 62 carries in it a sleeve 92 retained by a circlip 93 against outward displacement, the lower end of the sleeve 92 functioning as limit means to limit upward movement of the piston 70. This condition is illustrated in FIG. 5. The sleeve 92 has in it an annular groove 95 coupled to a gassing conduit 96 which is in turn coupled to the space 24 in the bowl 14 (see FIG. 1). A spool 97 is slidable in the sleeve 92, and in the condition of closed valves abuts the head 80 of poppet valve 81, in turn depressing the piston 70 which in turn closes the liquid flow valve 51.

Figure 4:
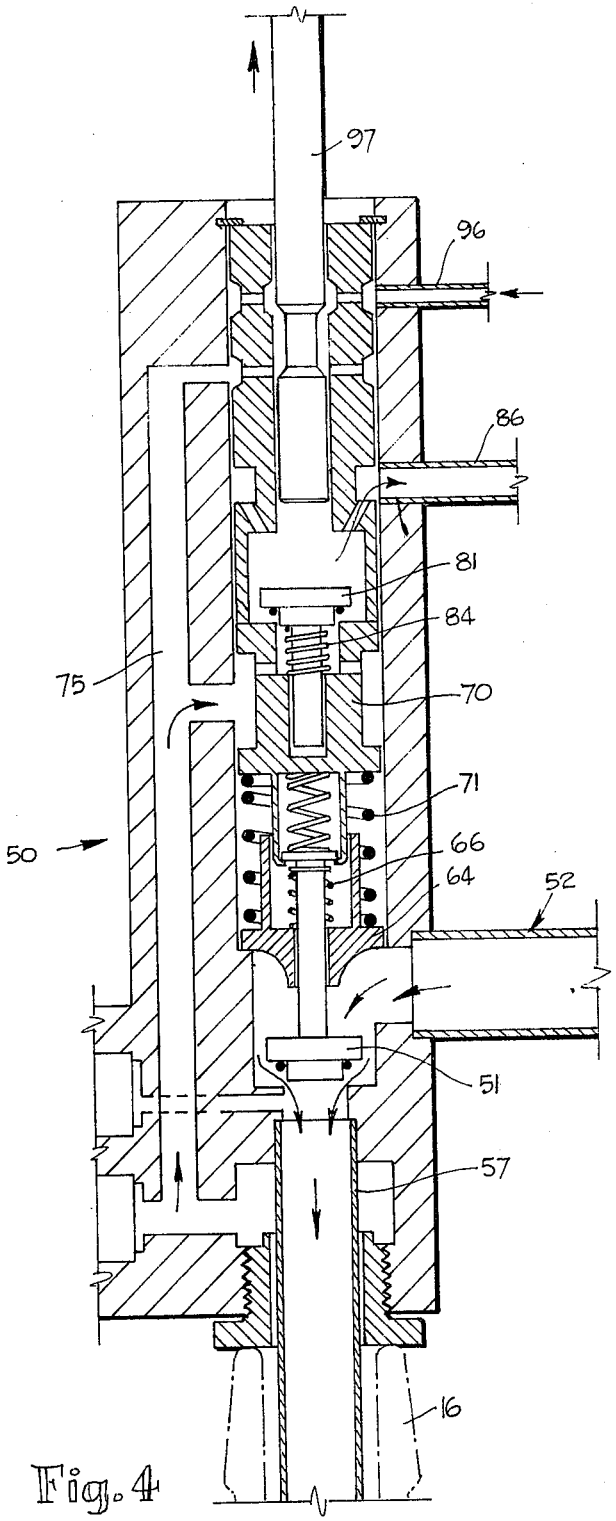
FIG. 4 is a view similar to FIG. 3 but showing the liquid flow and bottle venting valves in their partly open positions, namely at the first stage of filling a bottle with liquid.

When a bottle 16 is first positioned on the machine, it contains air at atmospheric pressure. However the poppet valves 51 and 81 are retained closed against their respective springs by pressure, the pressure against valve 51 passing from the wine bowl through the delivery tube 52, and the pressure against valve 81 through the venting tube 86. The spool 97 is raised (as shown in FIG. 4), allowing gas to flow from gassing conduit 96 into the bottle 16. As the pressure rises, it more nearly equalises the pressure in the wine bowl, and at a differential of 4 pounds per square inch, spring 66 lifts valve 51. This small differential is sufficient to urge wine to flow from the bowl 14, through delivery tube 52, and into bottle 16. The pressure difference continues to reduce, and at a differential of 2 pounds per square inch, the spring 84 lifts the venting valve 81 and venting proceeds as shown by the arrows in FIG. 4.

The valve body 50 contains two further poppet valves, one of the poppet valves designated 103 being a pressure release valve. The poppet valve 103 comprises a stem 104 and a head 15, the head 105 being urged towards a valve seat 106 by means of a compression spring 107 so as to normally close the valve 103. The valve seat 106 is contained in a sleeve 108. The outlet of the poppet valve 103 opens into a short conduit 109 which is exposed to atmosphere.

The other poppet valve is designated 113 and forms a tube venting valve, comprising a stem 114 and a head 115 urged against a valve seat 116 by a spring 117, the valve seat 116 being the inner end of a sleeve 118 and the outlet of the valve 113 communicating with a low pressure gas conduit 119, the two valves 104 and 114 being otherwise similar. The low pressure gas conduit 119 is coupled to the space 24, but contains in its length a pressure regulator 120 which is set to a very low pressure (about 1.5 pounds per square inch) so that the low pressure gas conduit functions merely to dispel the liquid contents of the syphon tube 57 as a bottle is removed after having been filled.

In the drawings of FIGS. 3 through to 8, only FIG. 3 has all the above designations attached thereto, for the sake of simplicity the other drawings are marked only with relevant designations to assist in following the description of the operation.

As shown in FIG. 1, the frame 11 carries on it two cams. The upper cam is a cam track designated 125 and this engages a roller on the projecting end of the spool 97, the spool 97 being raised and lowered upon rotation of the bowl 14, and with it the valve body 50. The other cam is designated 126 and co-operates with stem 114 of poppet valve 113. The frame also has on it a roller 127 which co-operates with the stem 104 of poppet valve 103. Upon rotation of the bowl 14, the elevating foot 15 firstly lifts the bottle 16 to sealably engage the lower end of the valve body 50 (FIG. 1). Thereupon the cam track 125 causes lift of the spool 97 to apply pressure gas to the bottle. As the spool 97 rises, the spring 68 lifts the piston 70, but the valves 51 and 81 are retained closed by pressure as described above until the bottle pressure is sufficient to enable the liquid flow valve 51 to open and liquid flow to commence down the syphon tube 57 into the bottle 16. This initial flow is caused by the higher pressure in the space 24. After a short period of flow spring 84 causes opening of the poppet valve 81 which is the bottle venting valve. The flow meter 90 is so adjusted that there is a slightly lower pressure in the manifold 87 than there is in the space 24, and consequently air and any carbon dioxide released from the liquid moves upwardly through the gas flow conduit 75 and outwardly through the gas venting tube 86, the manifold 87 and flow meter 90. This avoids the establishment of a higher air pressure than the gas pressure within the liquid, it dilutes the air with carbon dioxide. This stage of the filling is illustrated in FIG. 4 of the drawings.

As shown in FIG. 5 the upward position of the spool 97 allows the liquid flow valve 51 to fully open, and also allows the bottle venting valve 81 to fully open, so that there is a comparatively free flow of liquid into the bottle 16 through the syphon tube 57, and of air/carbon dioxide mixture through the valve 81 to atmosphere (through the flow meter 90). However as the spool 97 reaches its maximum height carbon dioxide at bowl pressure is transferred by the gassing conduit 96 past the spool valve 97 into the gas flow conduit 75. This has two functions. Firstly it still further dilutes any residual air which may be left in the conduit 75, and secondly it maintains equal pressures (through gas flow conduits 75) within the bottle 16 and within the bowl 14 so that continued flow is solely under the action of syphon, that is, the difference in height between the level 25 in the bowl 14 and the liquid level in the bottle 16. Thus the flow rate diminishes, the level then rising slowly in the bottle 16 until it reaches the level 25. This is a substantially non-turbulent flow of liquid, and it greatly diminishes the danger of boil over when the bottle is subsequently removed.

Figure 6:
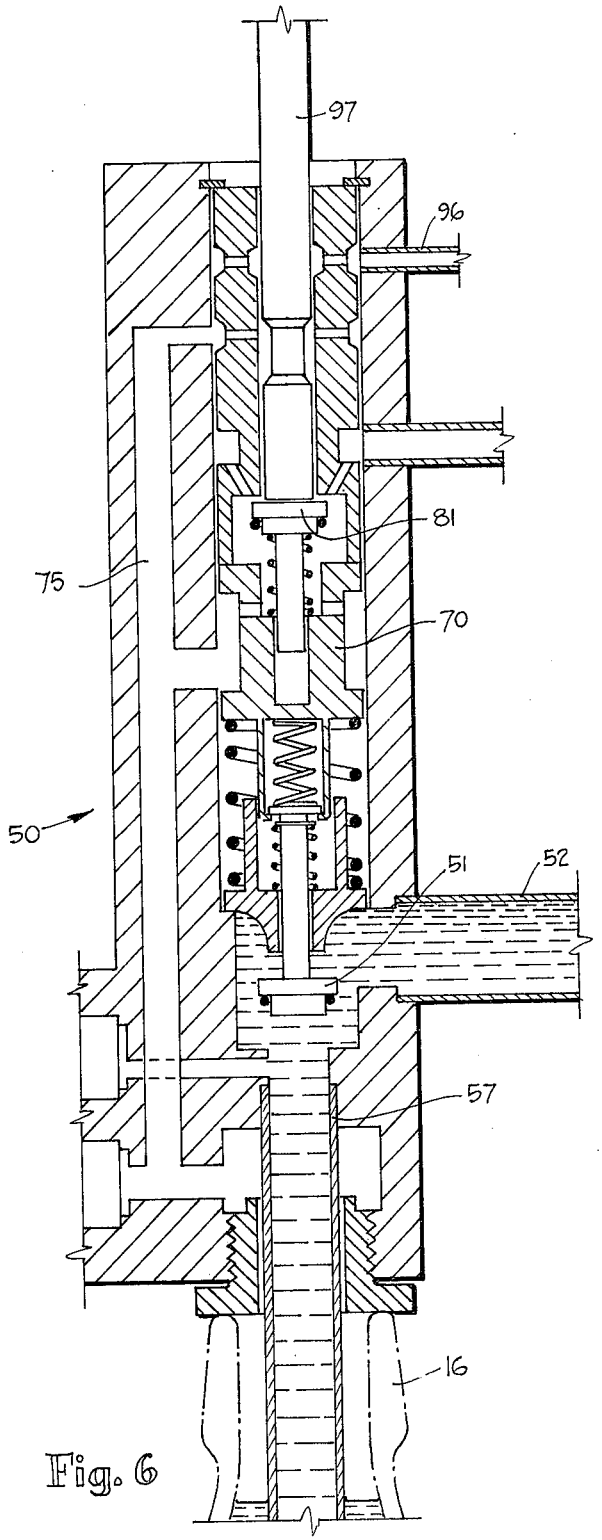
FIG. 6 is a section similar to FIGS. 3, 4 and 5, showing the gassing spool valve closed but the liquid flow and bottle venting valves still fully open (this being a neutral position for the valves)

However syphon is allowed to continue for a period of time during the circular traverse of the bowl 14. As shown in FIG. 6 the spool 97 is depressed to a neutral position where both the bottle venting valves, valve 81 and the liquid flow valve 51 are open. Once the pressure in the gas flow conduit 75 has been established to be that of the pressure in the space 24 of the bowl 14, there is no need for continued interconnection through the gassing conduit 96.

Figure 7:
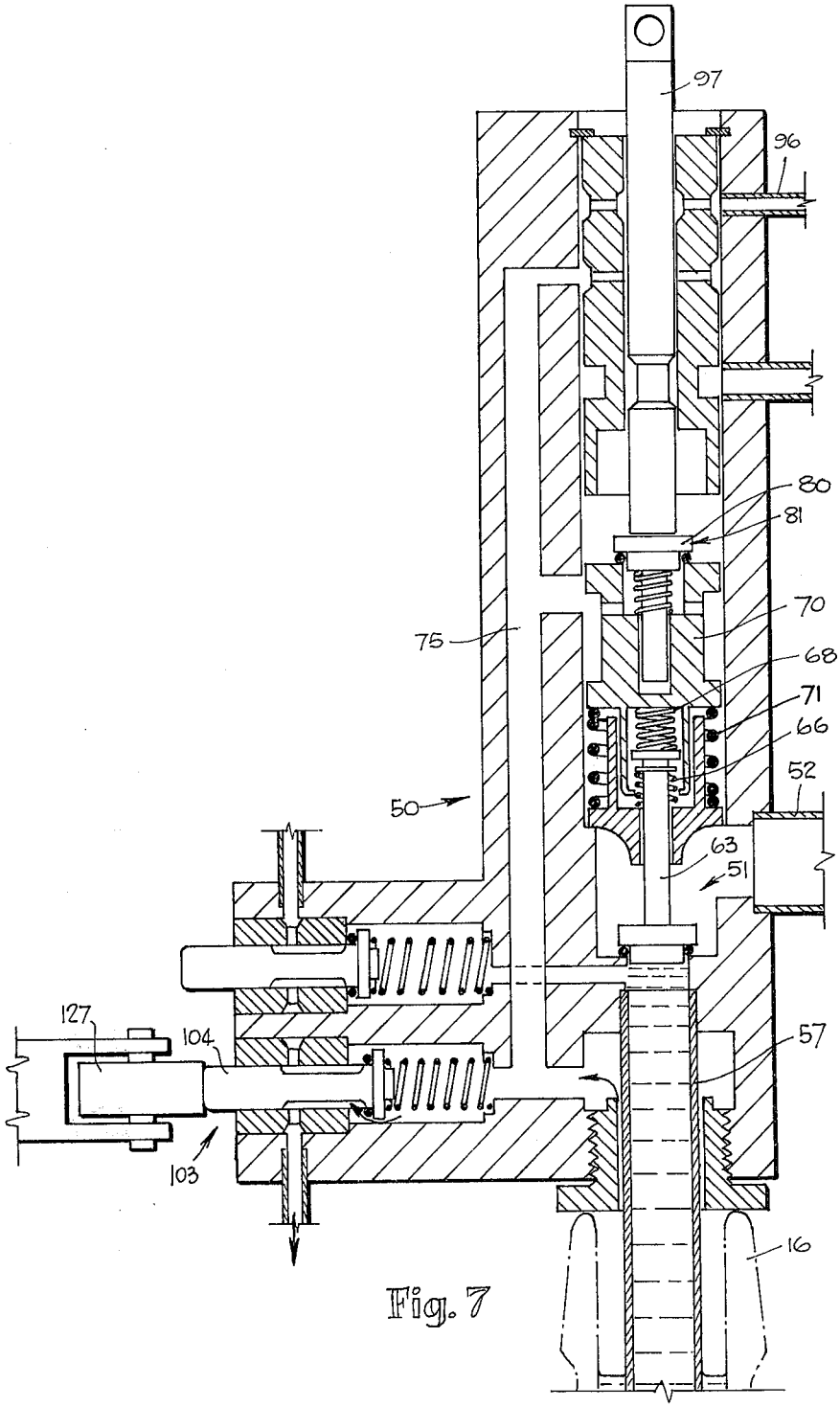
FIG. 7 is a section again similar to FIGS. 3 through to 6 showing the liquid flow and bottle venting valves closed but the pressure release valves opened.

Continued downwardly movement of the spool 97 is illustated in FIG. 7, the spool 97 abutting the head 80 of the poppet valve 81 thus closing the bottle venting valve, in turn driving down the piston 70, compressing springs 71 and 68, in turn compressing spring 66 which surrounds the stem 63 of the liquid flow valve 51 and thereby closing the liquid flow valve 51. The gas flow conduits 75 all still contain gas at the same pressure as the space 24 of the bowl 14 and this must be released. Release is effected by means of the gas release valve 103, the stem 104 of which is temporarily depressed by engagement with the roller 127 on the frame 11 (see also FIG. 1). This then maintains carbon dioxide within the neck of the bottle 16 but at atmospheric pressure and also allows the liquid and vent valves to be held shut by the bowl pressure. Although the liquid flow valve 51 is closed, the syphon tube 57 remains full of liquid and it is desirable that this should be transferred without turbulence into the bottle 16.

Figure 8:
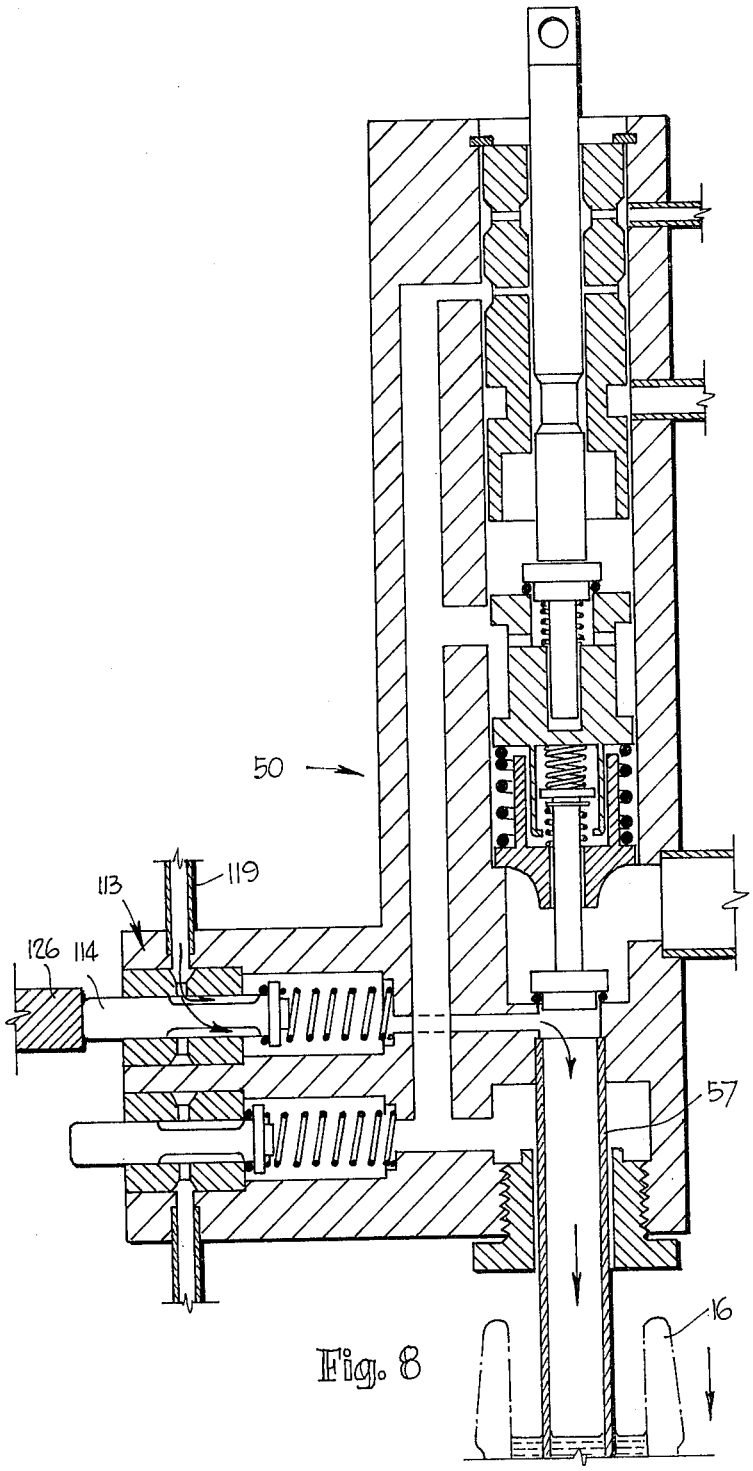
FIG. 8 illustrates removal of the bottle from the valve after the bottle has been filled with liquid.

FIG. 8 illustrates the means by which the contents of the syphon tube 57 are transferred into the bottle. In FIG. 8 the stem 114 of the poppet valve 113 is depressed by the cam 126, (see also FIG. 1) to allow very low pressure gas from the low pressure gas conduit 119 to flow into the syphon tube 57 and maintain the level therein at approximately the same level as the level of liquid in the bottle 16 during its descent.

The invention results in much faster bottle filling than has been achieved heretofore, less boil over and less oxidation of wines when they are bottled.

Various modifications of the illustrated embodiments of the disclosed invention are within the skill of the art. This invention is therefore not limited to the description and drawings and all such modifications are intended to be included within the scope of the appended claims.

What is claim is:

1. Bottle filling means suitable for the filling of a bottle with liquid contained in a bowl and containing gas under superatmospheric pressure, comprising:

a frame supporting the bowl, a liquid inlet conduit, a float valve, supported by the bowl in liquid flow communication with said conduit and having a liquid discharge outlet and a float contained within the bowl establishing a liquid level therein, a liquid flow valve carried by the bowl, a liquid delivery tube terminating at its inlet end in the bowl below the liquid level and at its outlet end in the inlet of said valve above the liquid level, and a syphon tube having an open lower end depending from the outlet of said valve and extending into the bottle;

a bottle venting valve, a gas flow conduit having its inlet adjacent the outer surface of said depending tube and extending to the inlet of the bottle venting valve, a flowmeter, and a gas venting tube extending from the outlet of said bottle venting valve to the inlet of the flowmeter, said flowmeter being operable to regulate rate of release of gas contained at pressure in the venting tube to atmosphere, and means for inducing syphon action flow of liquid from the bowl through the syphon tube comprising valve control means coupled to said valves whereby the opening of the liquid flow valve initiates the syphon action and the bottle venting valve is opened to vent displaced air or gas from the bottle as it is filled.

2. Bottle filling means according to claim 1 further comprising bearings interposed between the frame and bowl supporting the bowl for rotation about a vertical axis, said bowl having a closure member with a central aperture, said liquid inlet being a tube extending through said central aperture, a seal between the tube and walls defining said central aperture, said float valve being supported by the lower end of the inlet tube and contained wholly within the bowl.

3. Bottle filling means according to claim 2 wherein said float valve is a servo valve and comprises a cylinder, a cup-like member freely slidable in the cylinder, a master valve seat in the base of the cup-like member, a master valve member within the cup-like member and co-operable with the master valve seat, and means coupling the master valve member to said float, a slave valve seat in the base of the cylinder, and a slave valve annular surface on the bottom of the cup-like member co-operable with the slave valve seat, said liquid inlet tube opening into the cylinder through its side wall adjacent the slave valve seat.

4. Bottle filling means according to claim 1 further comprising a gassing valve, a gassing conduit extending from the bowl to the inlet of the gassing valve, said gas flow conduit extending to the outlet of the gassing valve.

5. Bottle filling means according to claim 1 further comprising a pressure release valve, said gas flow conduit extending to the inlet of the pressure release valve, the outlet of said pressure release valve being exposed to atmosphere.

6. Bottle filling means according to claim 1 further comprising a tube venting valve, a tube vent conduit extending from the syphon tube to the inlet of the tube venting valve, a low pressure gas conduit extending between the outlet of the venting valve and the bowl, and a pressure regulating valve in the low pressure gas conduit.

7. Bottle filling means suitable for the filling of a bottle with liquid contained in a bowl and containing gas under superatmospheric pressure, comprising:

a frame, bearings on the frame supporting the bowl for rotation about a vertical axis, a closure member over the bowl having a central aperture, a liquid inlet tube extending through said central aperture, a seal between the aperture and the inlet tube, a float valve on the lower end of the tube contained wholly within the bowl and establishing a liquid level within the bowl, a valve body containing a liquid flow valve secured to the bowl, a liquid delivery tube terminating at its inlet end in the bowl below said liquid level and its outlet end in the inlet of said liquid flow valve, and a syphon tube having an open lower end depending from the outlet of said liquid flow valve and extending into the bottle, a bottle venting valve contained in said valve body and co-axial with the liquid flow valve, a gas flow conduit within the valve body having as its inlet an annular space defined by walls of the valve body surrounding the syphon tube and extending to the inlet of the bottle venting valve, and means for inducing syphon action flow of liquid from the bowl to the bottle through the syphon tube comprising a gassing spool valve having its spool coaxial with the other said valves and being axially movable within the body to open or close said valves, a cam track on the frame, and cam engaging means on the spool engaging the cam track so that upon rotation of the bowl the spool is moved in an axial direction by the cam track, a flow meter, and a gas venting tube extending from the outlet of the bottle venting valve to the inlet of the flow meter, the flow meter being operable to regulate the rate of release of gas contained at pressure in the venting tube to atmosphere, a gassing conduit opening at one end into the the bowl and at the other end into the inlet of the spool valve, the spool upon being moved outwardly from the valve body opening the gassing valve whereby opening the liquid flow valve initiates the syphon action and the opening of the bottle venting valve allows gas or air in the bottle to vent through the flow meter.

8. Bottle filling means according to claim 7 wherein said valve body contains a central bore and all said valves are movable in an axial direction in the central bore, said liquid flow valve being a poppet valve having a stem slidable within the body and a head co-operable with an annular valve seat within the bore, the bore further containing a piston slidable therein and positioned upwardly of the liquid flow valve, the piston having a depending tube containing a compression spring and an abutment member which bears against the upper end of said liquid flow valve stem, the upper end of said piston having an annular venting valve seat, said venting valve also being a poppet valve having a stem depending into a central recess in the piston and a head co-operable with the venting valve seat, respective springs around the stems of both poppet valves biassing them towards respective open positions, the bore having limit means therein which limit upward movement of the piston and a piston spring beneath the piston urging it in an upward direction, the dimensions of the valves, piston and spool being such that upon downward movement of the spool, its lower end bears against the venting valve head and closes it against the venting valve seat, while continued downward movement drives the piston downwardly so that the abutment member bears against the end of the liquid flow valve stem and closes the liquid flow valve against its seat.

9. Bottle filling means according to claim 7 further comprising a tube venting valve in the valve body, a tube vent conduit extending through the body from the syphon tube to the venting valve inlet, a low pressure gas conduit extending between the outlet of the venting valve and the bowl, and a pressure regulating valve in the low pressure gas conduit, a pressure release valve in the valve body, said gas flow conduit extending to the inlet of the pressure release valve, the outlet of the pressure release valve being exposed to atmosphere, both the tube venting and pressure release valves being poppet valves having their heads urged outwardly to engage annular valve seats in the body by respective springs contained within the body, and having their stems projecting outwardly from the body, said frame comprising respective valve engaging means which engage the outwardly projecting stems upon rotation of the bowl, to thereby open the valves.

10. A method of filling a bottle with liquid containing gas under superatmospheric pressure comprising the steps:

a. charging a bowl with said liquid and with gas at superatmospheric pressure, b. positioning said bottle over a syphon tube, c. opening a liquid flow valve to initiate a syphon induced liquid flow from the bowl to the bottle and opening a bottle venting valve to vent displaced air or gas from the bottle and d. removing the bottle from the syphon tube after filling.

11. A method of filling a bottle according to claim 10 further comprising charging gas to said bottle from said bowl before said opening of the liquid flow and bottle venting valves, and venting the gas and any air contained in the bottle therefrom during said transfer of liquid from the bowl to the bottle.

12. A method of filling a bottle according to claim 10 wherein the step of positioning said bottle over said syphon tube urges the mouth of said bottle into sealable engagement with the valve body of the liquid flow valve, a. rotating the bowl to in turn effect opening of said liquid flow valve, so as to commence liquid flow through a liquid delivery tube and syphon tube under the influence of the gas pressure, then opneing said bottle venting valve to vent displaced gas from the bottle to atmosphere at a rate regulated by a flow meter, b. further rotating the bowl to effect closure of said valves, and c. lowering the bottle form the syphon tube while simultaneously further rotating the bowl to effect opening of a tube venting valve and consequential application of gas at low but superatmospheric pressure to said syphon tube.

13. The method of claim 12 comprising the step of applying gas at bowl pressure to the bottle being filled before effecting opening of said liquid flow and venting valves, said pressure being effective in causing said opening of these two valves.

* * * * *